US009487898B2

(12) United States Patent
He et al.

(10) Patent No.: US 9,487,898 B2
(45) Date of Patent: Nov. 8, 2016

(54) WASHING MACHINE AND WASHING MACHINE THEREOF

(75) Inventors: Zhengbao He, Qingdao (CN); Yimin Li, Qingdao (CN); Shilong Hao, Qingdao (CN); Chunfeng Lao, Qingdao (CN)

(73) Assignees: HAIER GROUP TECHNIQUE R&D CENTER, Qingdao, Shandong (CN); HAIER GROUP CORPORATION, Qingdao, Shandong (CN)

( * ) Notice: Subject to any disclaimer, the term of this patent is extended or adjusted under 35 U.S.C. 154(b) by 249 days.

(21) Appl. No.: 14/363,492

(22) PCT Filed: May 4, 2012

(86) PCT No.: PCT/CN2012/075083

§ 371 (c)(1),
(2), (4) Date: Jun. 6, 2014

(87) PCT Pub. No.: WO2013/086830

PCT Pub. Date: Jun. 20, 2013

(65) Prior Publication Data

US 2014/0283314 A1 Sep. 25, 2014

(30) Foreign Application Priority Data

Dec. 13, 2011 (CN) ..... 2011 1 0413484

(51) Int. Cl.

| | |
|---|---|
| ***D06F 21/14*** | (2006.01) |
| ***D06F 39/00*** | (2006.01) |
| ***D06F 39/02*** | (2006.01) |
| ***D06F 35/00*** | (2006.01) |
| ***D06F 37/06*** | (2006.01) |
| *D06F 31/00* | (2006.01) |
| *D06F 37/04* | (2006.01) |

(52) U.S. Cl.

CPC ..... *D06F 21/14* (2013.01); *D06F 35/00* (2013.01); *D06F 37/06* (2013.01); *D06F 39/006* (2013.01); *D06F 39/02* (2013.01); *D06F 31/005* (2013.01); *D06F 37/04* (2013.01)

(58) Field of Classification Search

CPC ..... D06F 35/00; D06F 37/06; D06F 15/00; D06F 21/14; D06F 58/22; D06F 39/006; D06F 39/02

USPC ..... 68/3 R, 12.18

See application file for complete search history.

(56) References Cited

U.S. PATENT DOCUMENTS 3,425,078 A * 2/1969 Lazaga ..... A47L 15/0002 15/3
5,601,480 A * 2/1997 Nilen ..... A47L 15/0002 451/88

(Continued)

FOREIGN PATENT DOCUMENTS

CN 2073434 U 3/1991
CN 201424587 Y * 3/2010

(Continued)

OTHER PUBLICATIONS

International Search Report (PCT/ISA/210) mailed on Aug. 23, 2012, by the Chinese Patent Office as the International Searching Authority for International Application No. PCT/CN2012/075083.

*Primary Examiner* — Joseph L Perrin
*Assistant Examiner* — Kevin G Lee
(74) *Attorney, Agent, or Firm* — Buchanan Ingersoll & Rooney PC

(57) ABSTRACT

A washing machine and washing method thereof comprises an inner tub, an outer tub and solid particles as washing medium. The inner tub, of which the inner wall is provided with lifting ribs protruding inward, rotates under the driving power of a driving device. Inside the washing machine, a storage tank for storing particles connects to the inner tub through a discharge channel for recycling particles and a feeding channel for putting in particles, and an air suction device is arranged on the feeding channel. Through alternate clockwise and counter-clockwise rotates of the inner tub, clothes and particles within are overturned in all directions, thus clothes and particles get better blended, and the cleaning rate gets improved. Meanwhile, putting-in and recycling particles through an air suction device is conducive to 100% recycling of particles.

19 Claims, 2 Drawing Sheets

(56) References Cited

U.S. PATENT DOCUMENTS

| | | | | |
|---|---|---|---|---|
| 6,280,301 | B1 * | 8/2001 | Rogmark | A47L 15/0002 451/447 |
| 2011/0296628 | A1 * | 12/2011 | Jenkins | D06F 35/00 8/137 |
| 2012/0284931 | A1 * | 11/2012 | Jenkins | D06F 23/025 8/137 |

FOREIGN PATENT DOCUMENTS

| | | | | |
|---|---|---|---|---|
| CN | 102061589 | A | | 5/2011 |
| JP | 03045296 | A | * | 2/1991 |
| JP | 2003275497 | A | * | 9/2003 |
| WO | WO 2010/094959 | A1 | | 8/2010 |
| WO | WO 2011/098815 | A1 | | 8/2011 |

* cited by examiner

Direction A

WASHING MACHINE AND WASHING MACHINE THEREOF

FIELD OF THE INVENTION

The present invention relates to a washing machine, in particular, to a washing machine utilizing particles in washing and a washing method thereof. It belongs to the technical field of washing machine.

BACKGROUND OF THE INVENTION

For washing method of traditional washing machines, water is taken as the washing medium; adding water and detergent into the washing machine, proceeding to wash, and draining the waste water in the washing machine by the dehydration function after washing, then re-adding clean water to continue washing or rinsing, and draining the water after the washing process is finished. In the method, the consumption of water is very great by simply draining water and re-adding clean washing water. Meanwhile, the detergent contains a lot of chemical substances which are harmful to the environment. Besides, each washing process is time-consuming and consumes more power.

To overcome the shortcomings of the traditional washing machines, in the prior art, a washing method with solid particles specially made of polymer materials as washing medium is provided. The dirt on clothes is absorbed by the fraction between solid particles and clothes, thus the function of washing is achieved. This washing method is able to save over 80% of water. Besides, these solid particles are recyclable, endurable, safe and environmentally friendly.

Washing machines of the washing method utilizing particles are usually arranged with a storage space for particles, and a feeding hole and a discharge hole on the outer tub. Before washing, putting particles into the outer tub through the feeding hole, and recycling all of them back to the storage space when the washing process is over. While recycling, the inner tub rotates at a high speed to throw the particles back to the storage space through centrifugal force. When dewatering the particles, putting them in and recycling them once again. Both the structure and washing procedures of the washing machines are quite complicated, and particles cannot be assured to be 100% recycled.

SUMMARY OF THE INVENTION

The object of the present invention is mainly to solve the aforesaid problems and overcome their shortcomings, and provides a washing machine which simplifies washing procedures, improves cleaning rate and is beneficial to recycling particles.

Another object of the present invention is to provide a washing method which simplifies washing procedures, improves cleaning rate and is beneficial to recycling particles.

To realize the aforesaid purposes, technical scheme of the present invention is:

A washing machine comprises an inner tub, an outer tub and particles as washing medium. The inner tub is driven to rotate by a driving device. A lifting rib protruding inward is arranged on the inner wall of the inner tub, A storage tank for storing particles is arranged in the washing machine, and the storage tank connects with the inner tub through a discharge channel for recycling particles and a feeding channel for putting particles in. Besides, an air suction device is arranged on the feeding channel.

Furthermore, the storage tank is communicated with the air suction device by a by-pass air channel. One end of the by-pass air channel connects with the storage tank, and the other end of the by-pass air channel connects with the feeding channel arranged between the storage tank and he air suction device through a three-way-valve.

Furthermore, a connecting port between the storage tank and the by-pass air channel is provided on the upper of the storage tank.

Furthermore, a filter net for blocking the particles is arranged on the connection port between the storage tank and the by-pass air channel.

Furthermore, a hold-up tank for storing the particles temporarily is arranged between the air suction device and the feeding channel, and both the air suction device and the hold-up tank is set above the outer tub.

Furthermore, a shifting board is arranged at the joint between the bottom of the hold-up tank and the feeding channel.

Furthermore, the storage tank is arranged beneath the outer tub.

Furthermore, the storage tank is an inverted truncated cone shaped structure.

Furthermore, an inlet of the feeding channel is arranged at the bottom of the storage tank.

Furthermore, a funnel structure for storing the particles temporarily is set at the inlet of the discharge channel.

Furthermore, both the inlet of the discharge channel and the outlet of the feeding channel are arranged at the front end of the inner tub close to the door of the washing machine.

Furthermore, the lifting ribs are arranged obliquely or spirally on the inner wall of the inner tub.

Furthermore, a length of the projection of the lifting ribs in the axial direction of the inner tub is identical with that of the side wall of the inner tub, or the lifting ribs are arranged spirally from the bottom to the top of the inner tub.

Furthermore, the number of the lifting ribs is 1-10 and the lifting ribs are evenly arranged along the wall of the inner tub.

Furthermore, an isolation tub with a net structure is arranged along the inner wall of the inner tub for separating clothes from particles, and both the bottom and top of the isolation tub are fixed to the bottom and top of the inner tub respectively.

Furthermore, a plurality of lifting blocks protruding inward is arranged on the wall of the isolation tub.

Another technical scheme of the present invention is:

A washing method, including the following steps:

Step I: putting particles in the storage tank into the inner tub of the washing machine through the air suction device arranged in the feeding channel, mixing particles with clothes and washing water, and turning them over together to wash the clothes;

Step II: after washing, draining the water, and separating the clothes and particles from and the washing water; and Step III: recycling the particles back to the storage tank along the discharge channel connected to the inner tub through the air suction device.

Furthermore, in Step I, the inner tub is driven to rotate clockwise and counter-clock wise in turns, and the particles are driven to overturn in the inner tub by the lifting ribs spirally or obliquely arranged on the inner wall of the inner tub.

Furthermore, in Step III, the inner tub is driven to rotate continuously, and the particles are driven to move towards the inlet of the discharge channel by the lifting ribs.

Furthermore, the inner tub rotates at a speed of 50-200 r/min in the process of washing clothes, putting and recycling particles.

In summary, in the washing machine and washing method thereof in the present invention, plurality of lifting ribs are set on the wall of the inner tub of the washing machine to overturn clothes and particles inside in all directions together with the alternate clockwise and counter-clockwise rotations of the inner tub, mixing particles and clothes to be washed more fully, thus improving the cleaning rate. Meanwhile, after the washing process is finished, clothes and particles can be dewatered simultaneously, simplifying the washing procedures. Besides, putting in and recycling particles with an air suction device is conducive to the 100% recycle of particles.

BRIEF DESCRIPTION OF THE DRAWINGS

As shown in FIGS. 1-4, an outer tub 1, an inner tub 2, particles 3, a driving device 4, clothes 5, lifting blocks 7, lifting ribs 8, a storage tank 9, a discharge channel 10, a feeding channel 11, an air suction device 12, a funnel structure 13, a hold-up tank 14, a board 15, a by-pass air channel 16, a three-way valve 17, a filter net 18 and a door of the washing machine 19.

EMBODIMENTS

Combining with the drawings and embodiments, the present invention is further elaborated:

Embodiment 1

Figure 1:
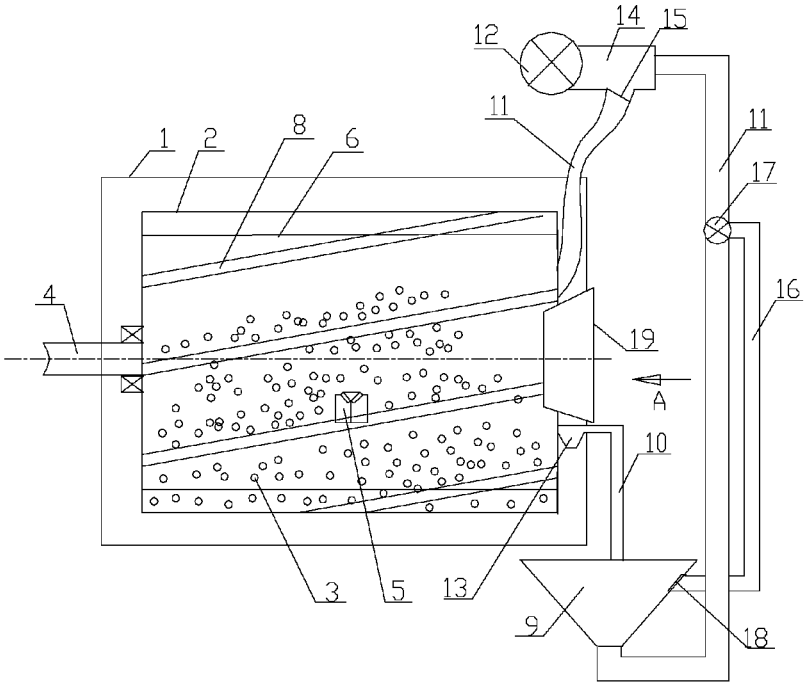
FIG. 1 is a structural schematic diagram of the embodiment of the prevent invention.
Figure 2:
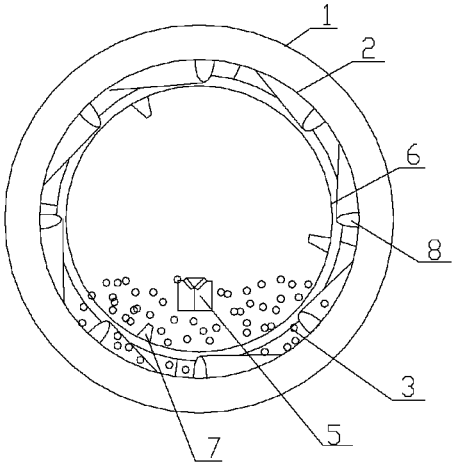
FIG. 2 is an A-auxiliary view of FIG. 1.

As shown in FIG. 1 and FIG. 2, a washing machine, taking a roller washing machine as an example for detailed description in the embodiment, comprises a shell (not shown in the figure), an outer tub 1, an inner tub 2 arranged in the shell, and solid particles 3 as washing medium. Wherein, the outer tub 1 is fixed, mainly for holding water, and the inner tub 2 is arranged at the inner of the outer tub 1 for washing, and several openings for allowing the washing water to flow through are arranged evenly on the wall of the inner tub 2. The diameter of the opening is less than that of the solid particles 3. The shape of the openings may be round, rectangle or polygon. The inner tub 2 is driven to rotate by a driving device 4. A water inlet (not shown in the figure) is arranged on the upper of the outer tub 1 for water inflow during washing and rinsing, and a water outlet (not shown in the figure) is arranged on the lower of the outer tub 1 for water draining after dewatering.

To be convenient for separating clothes 5 from particles 3, a circle of isolation tub 6 is arranged along the inner side of the inner tub 2 optionally. The clothes 5 are placed in the isolation tub 6. The bottom and top of the isolation tub 6 are fixedly connected with the bottom and top of the inner tub 2 respectively by fastenings, and rotate with the inner tub 2 synchronously. The isolation tub 6 is a net structure, so as to let the particles 3 and washing water flow in and out easier. The clothes 5 are isolated in the isolation tub 6, while the particles 3 are isolated between the isolation tub 6 and the inner tub 2. During washing, the particles 3 pass through the isolation tub 6 to fully mix with the clothes 5. Preferably, the particles 3 are made of polymer material with porous surface. With the preferable adsorption capacity of the particles 3, the dirt in the clothes 5 and washing water is adsorbed, thus reaches a preferable washing effect.

As with the ordinary roller washing machine, at least a lifting block 7 protruding inward is arranged in the inner wall of the isolation tub 6. During the washing, under the action of the lifting block 7, the clothes 5 turn up and down continually in the isolation tub 6, lifting and then falling down, to achieve the washing effect in cycles. The number of the lifting block 7 may be 1-3. In the embodiment, it's preferred to adopt 3 lifting blocks 7, which are arranged evenly along the circumference of the isolation tub 6.

In the shell of the washing machine, a storage tank 9 is arranged for storing the particles 3. The inlet of the storage tank 9 is communicated with the inner tub 2 via a discharge channel 10 for recycling the particles 3. The outlet of the storage tank 9 is communicated with the inner tub 2 via the feeding channel 11 for putting the particles 3. To simplify the structure of the washing machine, the inlet of the discharge channel 10 and the outlet of the feeding channel 11 are both arranged on the front end of the inner tub 2 close to the washing machine door 19.

On the inner wall of the inner tub 2, multiple lifting ribs 8 protruding inward are arranged in parallel. The lifting ribs 8 are arranged on the inner wall of the inner tub 2 obliquely and bend along the arc of the wall of the inner tub 2. The line between the two end points of the lifting ribs 8 forms an included angle relative to the axis of the inner tub 2. The included angle may be an acute angle or an obtuse angle, i.e. the lifting ribs 8 incline upward or downward along the wall of the inner tub 2. The lifting ribs 8 rotate with the inner tub 2, and drive the particles 3 as washing medium to move obliquely upward or downward along the lifting ribs 8. When the movement reaches a certain height, the particles 3 fall from the lifting ribs 8 to the inner tub 2, and to achieve overturn.

To avoid damaging the particles 3, in the embodiment, the cross section of the lifting ribs 8 is preferably streamline shape which roughly circular arc in shape. The diameter of the particles 3 is in the range of around 2-3 mm. The height of the lifting ribs 8 is preferably at least 5 mm, slightly less than or equal to the distance between the inner wall of the inner tub 2 and the outer wall of the isolation tub 6. The number of the lifting ribs 8 is 1-10, 5-8 preferably, which are arranged evenly along the wall of the inner tub 2. With more and higher lifting ribs 8, more particles 3 can be driven.

When washing the clothes 5, the inner tub 2 rotates clockwise and counterclockwise in turn. Under the action of centrifugal force, the particles 3 move obliquely upward or downward along the lifting ribs 8, move forward and backward and turn over along the axis of the inner tub 2 continually in the inner tub 2 to blend with the clothes 5 more fully, thereby improving cleaning rate. At this moment, the rotating speed of the inner tub 2 is no need to be very high. Washing speed is enough. Generally, it optionally rotates at a speed of 50-150 r/min. In the meantime, when recycling the particles 3, driving the inner tub 2 to run continuously in the direction opposite to the inclined direction of the lifting ribs 8, thus the particles 3 is driven to move toward the front end of the inner tub 2 by the lifting ribs 8. Finally the particles 3 flow out of the inner tub 2 through the front end thereof, and flow into the discharge channel 10 communicated with the inner tub 2. It is benefit of recycling the particles 3. In the process, the inner tub 2 rotates at a speed of 50-150 r/m.

An air suction device 12 is arranged on the feeding channel 11. In the embodiment, the air suction device 12 is a fan, of which the operating principle is similar to that of vacuum cleaner. The air suction device 12 is used for generating negative pressure in the feeding channel 11. Thereby the particles 3 are sucked out from the storage tank 9 and put into the inner tub 2.

The storage tank 9 with an inverted truncated cone structure is arranged below the outer tub 1. The outlet of the storage tank 9 is the inlet of the feeding channel 11, which is arranged at the bottom of the inverted truncated cone. Thus, it's beneficial to put all the particles 3 of the storage tank 9 into the inner tub 2.

A hold-up tank 14 for storing the particles 3 temporarily is arranged between the air suction device 12 and the feeding channel 11, in order to put the particles 3. In the embodiment, the air suction device 12 and the hold-up tank 14 are arranged above the outer tub 1. A shifting board 15 is arranged at the joint between the hold-up tank 14 and the feeding channel 11. The board 15 opens toward the inner tub 2. And the board 15 closes depending on the negative pressure produced by the air suction device 12, while opens automatically depending on the gravity of the particles 3 in the hold-up tank 14. Or the opening/closing of the board 15 is controlled in fixed time via the controller of the washing machine. The board 15 is connected with the shell of the hold-up tank 14 in an articulated manner. Or the board 15 is made of elastic rubber sheet, and bonding with the shell of the hold-up tank 14 or integrating injection molding. During putting the particles 3 in, starting the air suction device 12, the particles 3 are sucked out from the storage tank 9 and flow into the hold-up tank 14 first along the feeding channel 11. At the moment, the board 15 is closed by the negative pressure of the air suction device 12, After a certain amount of particles 3 flow into the hold-up tank 14 under the action of the negative pressure generated by the air suction device 12, stopping air suction, and opening the board 15 by using the gravity of the particles 3. Then the particles 3 is sucked repeatedly into the hold-up tank 14 until putting a certain amount of particles 3 into the inner tub 2. Or through controlling at regular time the opening/closing of the board 15, the particles 3 are put into the inner tub 2.

The storage tank 9 is communicated with the air suction device 12 by a by-pass air channel 16 for recycling the particles 3. One end of the by-pass air channel 16 is communicated with the storage tank 9, and the other end of the by-pass air channel 16 is communicated with the feeding channel 11 which is set between the storage tank 9 and the air suction device 12 via a three-way valve 17. The three-way valve 17 make optionally the air suction device 12 connect with the feeding channel 11 or the by-pass air channel 16. The connecting port between the storage tank 9 and the by-pass air channel 16 is set on the upper of the storage tank 9, thus can avoid the by-pass air channel 16 being blocked by the particles 3 during recycling. The connecting port between the storage tank 9 and the by-pass air channel 16 is provided with a filter net 18 for blocking the particles 3, avoiding the particles 3 entering the by-pass air channel 16. A funnel structure 13 is arranged at the inlet of the discharge channel 10. The funnel structure 13 is set at the bottom of the window pad of the front end of the inner tub 2. As part of the window pad, the funnel structure plays a transition role in storing the particles 3 from the inner tub 2 temporarily, and can temporarily store a small handful of particles 3 flowing from the inner tub 2 in washing. The capacity of the funnel structure 13 is can be very low, which is not only able to simplify the connection structure between the discharge channel 10 and the inner tub 2, but also more beneficial for recycling particles 3.

When it's required to recycle the particles 3, the air suction device 12 is started and connects with the by-pass air channel 16 by controlling the three-way valve 17. Thus, the particles 3 in the inner tub 2 is first driven to flow into the funnel structure 13 by the lifting ribs 8, and to flow continually into the storage tank 9 along the discharge channel 10 under the suction of the air suction device 12. At this moment, the feeding channel 11 is closed, so the particles 3 are stored in the storage tank 9. The recycling of the particles 3 is completed.

Figure 3:
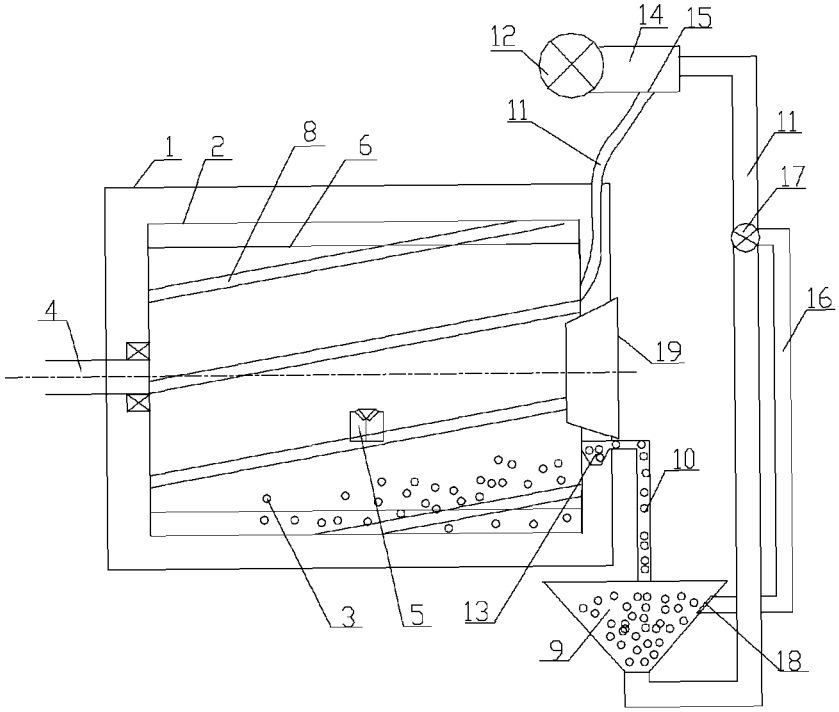
FIG. 3 is a schematic diagram of a process of putting particles in the embodiment of the present invention.
Figure 4:
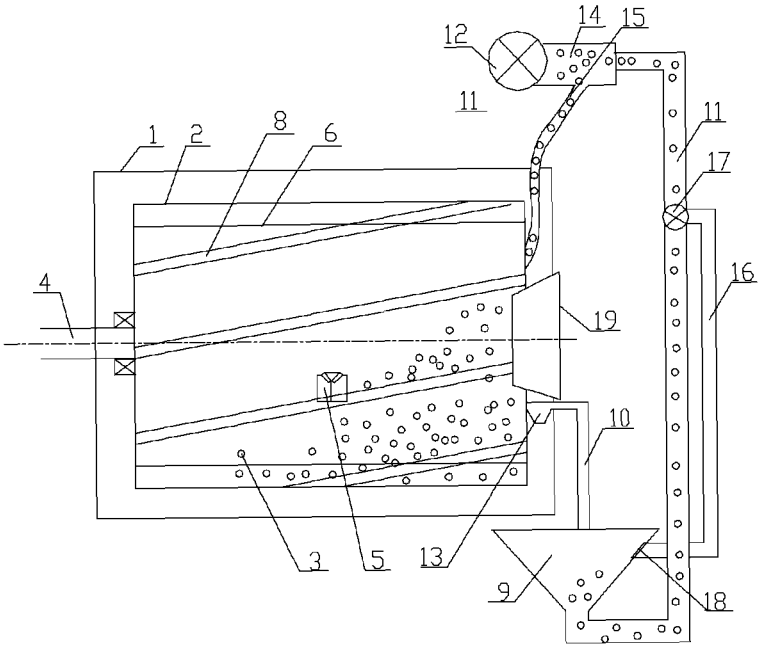
FIG. 4 is a schematic diagram of a process of recycling particles in the embodiment of the present invention.

Combining FIG. 3 and FIG. 4, the washing method of the aforesaid roller washing machine is further described.

The washing method comprises the following steps:

Step I: Putting the clothes 5 to be washed into the isolation tub 6 of the washing machine, and opening the water inlet above the outer tub 1 for adding washing water; the washing water mixed with detergent flows into the outer tub 1; through the openings on the inner tub 2 and the isolation tub 6, the water flows into the isolation tub 6 and mixes with the clothes 5 to be washed fully. In the process, it's only needed to add in moderate water and detergent to ensure the clothes 5 to be soaked in the water.

When injecting washing water to soak the clothes 5 to be washed, the clothes 5 are soaked for a certain time. Thus the clothes 5 is fully infiltrating with water so as to further improve the washing effect.

Step II: As shown in FIG. 2, the air suction device 12 is started and connects with the feeding channel 11 by controlling the three-way valve 17; the particles 3 are sucked out from the storage tank 9, and first flow into the hold-up tank 14 along the feeding channel. At this moment, the board 15 is closed by the negative pressure of the air suction device 12. When the particles 3 in the hold-up tank 14 reach a certain weight, the air suction device 12 was suspended and the board 15 opens. Then the particles 3 are put into the inner tub 2 along the next section of feeding channel 11.

In this step, the inner tub 2 rotates at a low speed of 50-150 r/min, which is beneficial to the full contact between the particles 3 in the inner tub 2 and the clothes 5.

Step III: After a certain amount of particles 3 as required are put into the inner tub 2, which is controlled by restricting the putting time, the inner tub 2 is driven to rotate clockwise for a period of time, stop, and then rotate counterclockwise for a period of time by the driving device 4. Likewise, the lifting ribs 8 rotate clockwise and counterclockwise alternately too, thus, the particles 3 move forward or backward continually in the inner tub 2. The particles 3 move obliquely upward along the lifting ribs 8, and when reaching a certain height, the particles 3 flip down and fall into the inner tub 2. It is achieved to overturn in forward and backward directions. During the washing, under the impact of the lifting block 7, the clothes 5 turn up and down.

During the washing, the particles 3, clothes 5 and washing water are fully blended, lift and decline continually under the impact of the lifting blocks 7 and the lifting ribs 8, thereby finishing the washing of the clothes 5.

In this step, when the rotating speed of the inner tub 2 is between 100-200 r/min, it can obtain the best effect.

Step IV: After the washing, the water is drained, and the clothes 5 is separated from the particles 3 and washing water preliminarily.

Step V: The inner tub 2 rotates at a high speed, and clothes 5 and particles 3 in the inner tub 2 simultaneously dewater. The recycling of the particles 3 is achieved. The washing water is collected in the outer tub 1 and discharged via the water outlet of the bottom of the outer tub 1.

In this step, the inner tub rotates 2 at a speed of 100-1000 r/min, generally higher than the speed during washing.

Step VI: After dewatering, the air suction device 12 is started and connects with the by-pass air channel 16 by controlling the three-way valve 17. Meanwhile, the inner tub 2 is driven to rotate continuously in the direction opposite to the inclined direction of the lifting ribs 8, thus the particles 3 is driven to move toward the front end of the inner tub 2 by the lifting ribs 8. The particles 3 flow into the funnel structure 13 first, and continuously flow into the storage tank 9 along the discharge channel 10 under the suction of the air suction device 12. At this moment, the feeding channel 11 is closed, so the particles 3 are stored in the storage tank 9. The recycling of the particles 3 is completed.

In the process, the inner tub 2 rotates at a speed of 50-150 r/min.

Step VII: Rinsing step, adding moderate clean water into the outer tub 1 again, the clothes 5 is rinsed according the aforesaid process. Then the aforesaid dewatering process is performed again after rinsing. All the washing process for the clothes 5 is accomplished.

In the process, the particles 3 can also be put in, and rinsing the clothes 5 and the particles 3 simultaneously. The whole rinsing process is completed according to the aforesaid steps.

Or, after taking out of the clothes 5, the particles 3 are put in for rinsing separately.

Embodiment 2

The difference from Embodiment 1 is that the number of the lifting rib 8 is one, which is spirally arranged along the inner wall of the inner tub 2 from the bottom to the top of the inner tub 2.

Other structures and working process are the same as Embodiment 1, thereby no additional detailed description here.

As aforesaid, combining the scheme provided by the drawings, similar technical scheme may be derived. However, without departing from the technical scheme of the present invention, any tiny modification, equivalent change or alteration on the aforesaid embodiments based on the technical essence of the present invention, still belongs to the technical scope of the present invention.

The invention claimed is:

1. A washing machine, comprising an inner tub, an outer tub and particles as washing medium, and the inner tub being driven to rotate by a driving device, wherein, a lifting rib protruding inward is arranged on the inner wall of the inner tub, a storage tank for storing particles is arranged in the washing machine, the storage tank connects with the inner tub through a discharge channel for recycling particles from the inner tub and a feeding channel for putting particles into the inner tub, and an air suction device is arranged on the feeding channel, wherein, the storage tank communicates with the air suction device by a by-pass air channel, one end of the by-pass air channel connects with the storage tank, and the other end of the by-pass air channel connects with the feeding channel through a three-way-valve arranged on the feeding channel between the storage tank and the air suction device.

2. The washing machine according to claim 1, wherein, a connecting port between the storage tank and the by-pass air channel is provided on an upper portion of the storage tank.

3. The washing machine according to claim 1, wherein, a filter net for blocking the particles is arranged on a connection port between the storage tank and the by-pass air channel.

4. The washing machine according to claim 1, wherein, a hold-up tank for storing the particles temporarily is arranged between the air suction device and the feeding channel, and both the air suction device and the hold-up tank is set above the outer tub.

5. The washing machine according to claim 4, wherein, a shifting board is arranged at a joint between the bottom of the hold-up tank and the feeding channel.

6. The washing machine according to claim 1, wherein, the storage tank is arranged beneath the outer tub.

7. The washing machine, according to claim 6, wherein, the storage tank is an inverted truncated cone shaped structure.

8. The washing machine according to claim 7, wherein, an inlet of the feeding channel is arranged at the bottom of the storage tank.

9. The washing machine according to claim 1, wherein, a funnel structure for storing the particles temporarily is set at the inlet of the discharge channel.

10. The washing machine according to claim 1, wherein, both the inlet of the discharge channel and the outlet of the feeding channel are arranged at the front end of the inner tub close to a door of the washing machine.

11. The washing machine according to claim 1, wherein, the lifting rib is arranged obliquely or spirally on the inner wall of the inner tub.

12. The washing machine according to claim 11, wherein, a length of a projection of the lifting rib in the axial direction of the inner tub is identical with that of the side wall of the inner tub, or the lifting rib is arranged spirally from one end of the inner tub close to a door to an opposite side of the inner tub.

13. The washing machine according to claim 1, comprising:

a single lifting rib constituted by the lifting rib; or two to ten lifting ribs including the lifting rib, the two to ten lifting ribs being evenly arranged along the wall of the inner tub.

14. The washing machine according to claim 1, wherein, an isolation tub with a net structure is arranged along the inner wall of the inner tub for separating clothes from particles, and both one end close to a door and an opposite end of the isolation tub are fixed to one end close to a door and an opposite end of the inner tub respectively.

15. The washing machine according to claim 14, wherein, a plurality of lifting blocks protruding inward is arranged on the wall of the isolation tub.

16. A washing method using the washing machine according to claim 1, the washing method comprising the following steps:

Step I: putting particles in the storage tank into the inner tub of the washing machine through the air suction device arranged in the feeding channel, mixing particles with clothes and washing water, and turning them over together to wash the clothes;

Step II: after washing, draining the water, and separating the clothes and particles from the washing water; and Step III: recycling the particles back to the storage tank along the discharge channel connected to the inner tub through the air suction device.

17. The washing method according to claim 16, wherein, in Step I, the inner tub is driven to rotate clockwise and counter-clock wise in turns, and the particles are driven to overturn in the inner tub by the lifting rib spirally or obliquely arranged on the inner wall of the inner tub.

18. The washing method according to claim 17, wherein, in Step III, the inner tub is driven to rotate continuously, and the particles are driven to move towards the inlet of the discharge channel by the lifting ribs.

19. The washing method according to claim 17, wherein, the inner tub rotates at a speed of 50-200 r/min in the process of washing clothes, putting and recycling particles.

* * * * *